US008539788B2

(12) United States Patent
Katsumi et al.

(10) Patent No.: US 8,539,788 B2
(45) Date of Patent: Sep. 24, 2013

(54) VENTILATING AND AIR CONDITIONING APPARATUS

(75) Inventors: Yoshimasa Katsumi, Aichi (JP); Hiroyuki Kondou, Aichi (JP); Mitunori Matubara, Gifu (JP); Masafumi Tsubouchi, Aichi (JP)

(73) Assignee: Panasonic Corporation, Osaka (JP)

( * ) Notice: Subject to any disclaimer, the term of this patent is extended or adjusted under 35 U.S.C. 154(b) by 1088 days.

(21) Appl. No.: 12/303,126

(22) PCT Filed: Jul. 10, 2007

(86) PCT No.: PCT/JP2007/063710

§ 371 (c)(1),
(2), (4) Date: Dec. 2, 2008

(87) PCT Pub. No.: WO2008/007657

PCT Pub. Date: Jan. 17, 2008

(65) Prior Publication Data

US 2009/0188027 A1 Jul. 30, 2009

(30) Foreign Application Priority Data

Jul. 12, 2006 (JP) ..... 2006-191422
Mar. 19, 2007 (JP) ..... 2007-070176

(51) Int. Cl.

| | |
|---|---|
| ***F25D 23/12*** | (2006.01) |
| ***F25B 13/00*** | (2006.01) |
| ***F25B 29/00*** | (2006.01) |
| ***F24H 3/00*** | (2006.01) |
| ***F24H 9/06*** | (2006.01) |

(52) U.S. Cl.
USPC ..... 62/259.1; 62/324.1; 165/47; 165/48.1; 165/53

(58) Field of Classification Search
USPC ..... 62/159, 160, 238.7, 259.1, 324.1; 165/47, 48.1, 50, 53, 54, 56
See application file for complete search history.

(56) References Cited

U.S. PATENT DOCUMENTS 4,018,266 A 4/1977 Kay
4,786,300 A * 11/1988 Uematsu et al. ..... 62/259.1

(Continued)

FOREIGN PATENT DOCUMENTS

CN 1757995 4/2006
EP 1 645 817 4/2006

(Continued)

OTHER PUBLICATIONS

International Search Report of PCT Application No. PCT/JP2007/063710 dated Oct. 23, 2007.

*Primary Examiner* — Frantz Jules
*Assistant Examiner* — Henry Crenshaw
(74) *Attorney, Agent, or Firm* — Panasonic Patent Center

(57) ABSTRACT

An ventilating and air conditioning apparatus includes a circulating fan for sucking air from a sucking port open to a first indoor space and blowing the air through a blowout port into the first indoor space, a ventilating fan for sucking air from an exhausting port open to a second indoor space and evacuating the air to the outdoors for ventilation, and a refrigerant circuit formed of a compressor for compressing a refrigerant, a first heat exchanger for exchanging heat of air blown into the first indoor space by the circulating fan with the refrigerant, an expanding mechanism for expanding the refrigerant, and a second heat exchanger for exchanging heat of air blown into the second indoor space by the ventilating fan with the refrigerant. The compressor, first heat exchanger, expanding mechanism, and second heat exchanger are coupled together with pipes for the refrigerant to circulate therethrough in this order.

29 Claims, 7 Drawing Sheets

(56) References Cited

U.S. PATENT DOCUMENTS

| | | | | | |
|---|---|---|---|---|---|
| 5,642,627 | A | * | 7/1997 | Iritani et al. | 62/156 |
| 6,012,294 | A | * | 1/2000 | Utsumi | 62/81 |
| 6,050,102 | A | * | 4/2000 | Jin | 62/324.6 |
| 2004/0000399 | A1 | * | 1/2004 | Gavula | 165/299 |
| 2004/0250561 | A1 | * | 12/2004 | Kim et al. | 62/259.1 |

FOREIGN PATENT DOCUMENTS

| | | | | |
|---|---|---|---|---|
| EP | 1645817 | | | 4/2006 |
| EP | 1645817 | A2 | * | 4/2006 |
| JP | H02-13950 | U | | 1/1990 |
| JP | H2-106520 | | * | 8/1990 |
| JP | H02-106520 | U | | 8/1990 |
| JP | H2106520 | | * | 8/1990 |
| JP | H05-231675 | | | 9/1993 |
| JP | H06-117660 | | | 4/1994 |
| JP | 2001-82759 | | | 3/2001 |
| JP | 2001-082759 | | | 3/2001 |
| JP | 2002-349930 | | | 12/2002 |
| JP | 2004-093008 | | * | 3/2004 |
| JP | 2004-251557 | | | 9/2004 |
| JP | 2005-180712 | | * | 7/2005 |
| JP | 2005-241160 | | | 9/2005 |
| JP | 2006-105560 | | | 4/2006 |

* cited by examiner

FIG. 5

| Opration pattern / Major elements | Arround-the-Clock Ventilation | Dry | Dehumidify | Cool the bathroom | preheat | | Heat for bathing | |
|---|---|---|---|---|---|---|---|---|
| | | | | | | Defrost | | Defrost |
| Ventilating fan | Weak notch | Strong notch | Weak notch | Strong notch | Strong notch | Halt | Strong notch | Strong notch |
| Shutter | Open state | Open state | Closed state | Closed state | Closed state | Closed state | Closed state | Closed state |
| Circulating fan | Halt | Given notch | Given notch | Given notch | Given notch | Halt | Given notch | Given notch |
| Compressor | Halt | run | run | run | run | run | run | run |
| Flow-path switching valve | — | Heating cycle | Heating cycle | Cooling cycle | Heating cycle | Cooling cycle | Heating cycle | Heating cycle |
| Expanding mechanism (electronic expanding valve) | — | Given open angle | — | Given open angle | Given open angle | Given open angle | Given open angle | Fully closed |
| First on/off valve | — | Closed state | Closed state | Closed state | Closed state | Closed state | Closed state | Open state |
| Second on/off valve | — | Closed state | Open state | Closed state | Closed state | Closed state | Closed state | Open state |
| Third on/off valve | — | Open state | Closed state | Open state | Open state | Open state | Open state | Open state |
| Auxiliary heater | Halt | Halt | Halt | Halt | Halt | Halt | Run | Run |
| Preheater | Halt | Halt | Halt | Halt | Halt | Halt | Halt | Run |
| Coolant heating device | Halt | Halt | Halt | Halt | Halt | Halt | Halt | Run |

FIG. 6

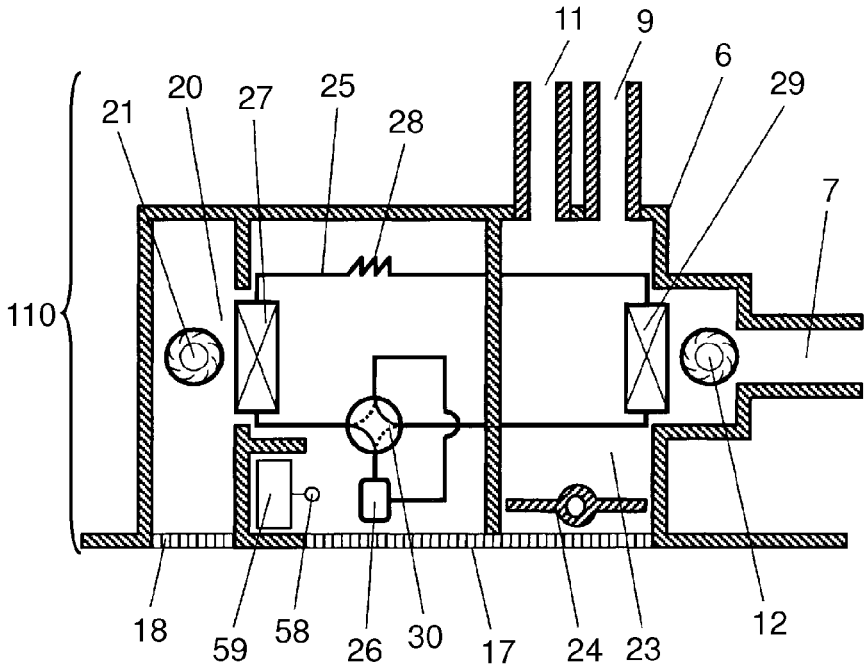

FIG. 7

| Operation pattern / Major element | Arround-the-Clock Ventilation | Dry | Cool | Heat |
|---|---|---|---|---|
| Circulating fan | Halt | Given notch | Given notch | Given notch |
| Compressor | Halt | Run | Run | Run |
| Flow-path switching valve | —— | Heating cycle | Cooling cycle | Heating cycle |
| Shutter | Open state | Open state | Closed state | Closed state |
| Ventilating fan | Weak notch | Strong notch | Determine based on an indication of the temperature sensor | Determine based on an indication of the temperature sensor |

VENTILATING AND AIR CONDITIONING APPARATUS

TECHNICAL FIELD

The present invention relates to a ventilating and air-conditioning apparatus for ventilating and air-conditioning a bathroom by using a heat pump.

BACKGROUND ART

A conventional ventilating and air-conditioning apparatus using a heat pump for a bathroom has worked this way: A first heat exchanger of the heat pump radiates or absorbs heat to/from the air taken in from outside the bathroom, and then blows out the air into the bathroom. A second heat exchanger of the heat pump absorbs or radiates heat from/to air evacuated from the bathroom to the outdoors. The bathroom has been thus air-conditioned (refer to, e.g. Patent Document 1).

There is another conventional ventilating and air-conditioning apparatus. A heat pump is split into an outdoor unit and an indoor unit. A heat exchanger placed in the outdoor unit absorbs or radiates heat from/to the open air, and a heat exchanger placed in the indoor unit radiates or absorbs heat to/from the air in a bathroom, which is thus air-conditioned (refer to, e.g. Patent Document 2).

As discussed above, various ventilating and air-conditioning apparatus using a heat pump for a bathroom have been proposed. The bathroom air-conditioner disclosed in Patent Document 1 collects heat from air evacuated from the bathroom to the outdoors for air-conditioning the bathroom. However, the heat exchanger disclosed in Patent Document 1 cannot collect 100% of the heat from the evacuated air, so a part of the heat (energy of cooled air) having been used for the air-conditioning of the bathroom leaks to the outdoors. The leak incurs heat loss, which results in a lower thermal efficiency.

The bathroom air-conditioner disclosed in Patent Document 2, on the other hand, leaks a smaller amount of the heat having been used for the air-conditioning of the bathroom. However, since the heat pump is separated into the indoors and the outdoors of the bathroom, piping work for refrigerant to travel through is needed in order to connect the inside to the outside of the bathroom, so that installing work becomes inefficient. On top of that, this air-conditioner needs a space for the outdoor unit.

Patent Document 1: Unexamined Japanese Patent Application Publication No. 2005-180712

Patent Document 1: Unexamined Japanese Patent Application Publication No. 2002-349930

DISCLOSURE OF INVENTION

A ventilating and air-conditioning apparatus of the present invention comprises the following elements:

- a circulating fan sucking air through a sucking port open to a first indoor space, and blowing out the air through a blowout port open to the first indoor space;
- a ventilating fan sucking air through an evacuating port open to a second indoor space, and evacuating the air to the outdoors for ventilation;
- a refrigerant circuit including:
  - a compressor for compressing a refrigerant;
  - a first heat exchanger for exchanging heat of the air blown into the first indoor space by the circulating fan with the refrigerant;

- an expanding mechanism for expanding the refrigerant; and
  - a second heat exchanger for exchanging heat of the air blown into the second indoor space by the ventilating fan with the refrigerant, wherein the compressor, the first heat exchanger, the expanding mechanism, and the second heat exchanger are coupled to each other with pipes for the refrigerant to circulate therein.

The foregoing structure allows the refrigerant in the second heat exchanger to absorb heat from the air evacuated by the ventilating fan from the second indoor space to the outdoors, and allows the refrigerant in the first heat exchanger to radiate heat to the air circulated by the circulating fan in the first indoor space. The heat pump thus works to air-condition the first indoor space, so that the air having undergone the heat exchange in the first heat exchanger does not leak outside the first indoor space. The first indoor space thus can be air-conditioned effectively and the thermal efficiency can be improved. On top of that, the ventilating and air-conditioning apparatus placed under the roof of the first indoor space can accommodate the refrigerant circuit which is formed of the compressor, the first heat exchanger, the expanding mechanism and the second heat exchanger. The structure discussed above thus can improve the installing work, and save a space.

BRIEF DESCRIPTION OF THE DRAWINGS

FIG. 5 shows working states of the ventilating and air-conditioning apparatus in response to respective work patterns.

FIG. 6 shows an air course structure and a refrigerant circuit of a ventilating and air-conditioning apparatus in accordance with a second embodiment of the present invention.

FIG. 7 shows working states of the ventilating and air-conditioning apparatus in response to respective work patterns.

DESCRIPTION OF REFERENCE MARKS

Figure 1:
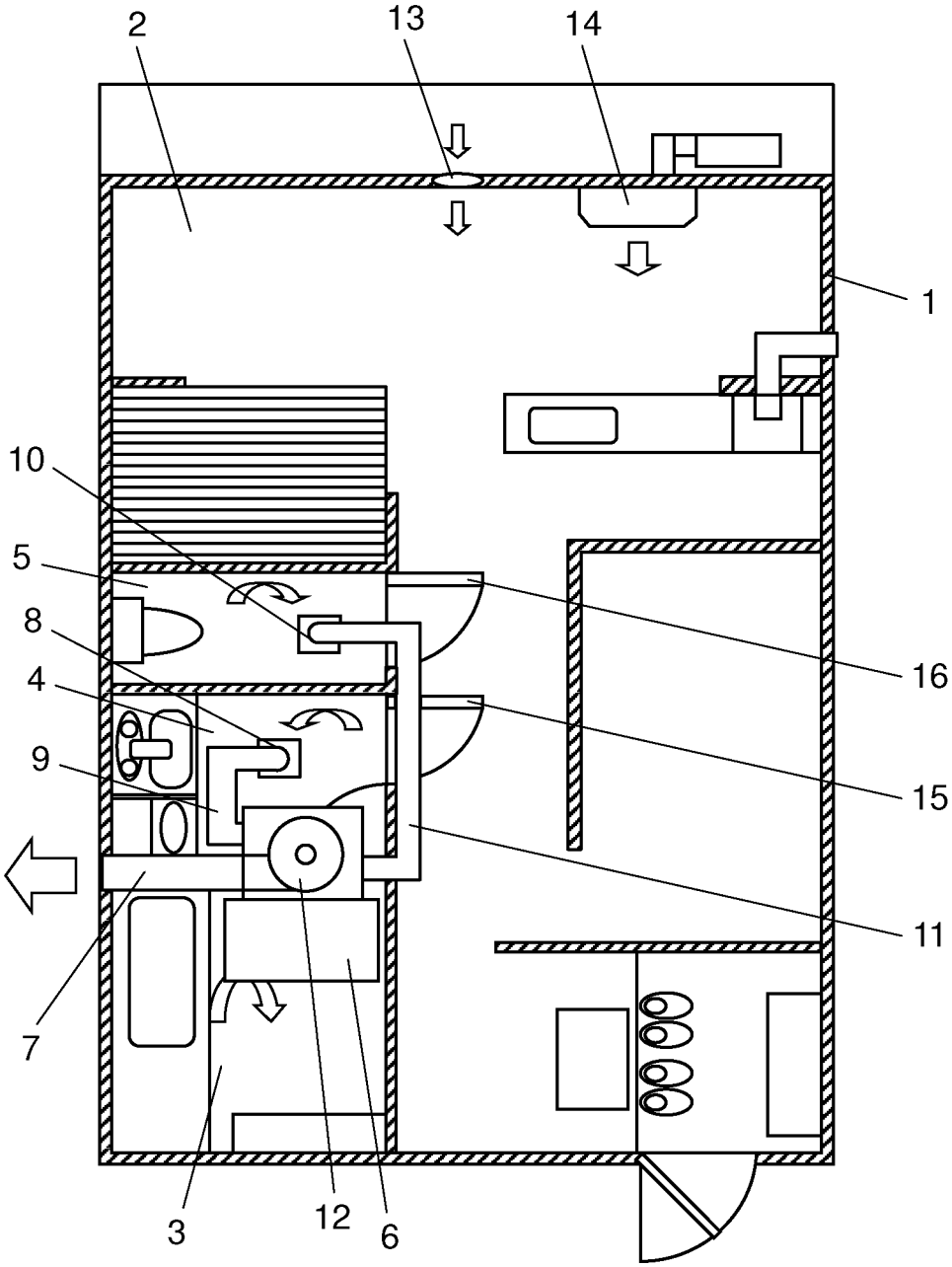
FIG. 1 shows a floor plan of a living space where a ventilating and air-conditioning apparatus in accordance with a first embodiment of the present invention is placed.

3 bathroom (first indoor space)
4 dressing room (second indoor space)
5 toilet room (second indoor space)
8, 10 evacuating port
12 ventilating fan
14 air-conditioner

17 sucking port
18 blowout port
21 circulating fan
22 auxiliary heater
23 ventilation path
24 shutter
25 refrigerant circuit
26 compressor
27 first heat exchanger
28 expanding mechanism
29 second heat exchanger
30 flow-path switching valve
31, 32 bypass circuit
33 first on-off valve
34 second on-off valve
35 refrigerant heating device
38 decompressing device
39 pre-heater
40 refrigerant heater
47 refrigerant-hydrothermal exchanger
59 controller
100, 110 ventilating and air-conditioning apparatus

DESCRIPTION OF PREFERRED EMBODIMENTS

Embodiment 1

The first embodiment of the present invention is demonstrated hereinafter with reference to FIG. 1-FIG. 5. FIG. 1 shows a floor plan of a living space where a ventilating and air-conditioning apparatus in accordance with the first embodiment of the present invention is placed. In FIG. 1, living space 1 is divided into living room 2, bathroom 3 equal to a first indoor space, dressing room 4 and toilet room 5 equal to a second indoor room, and so on. Main unit 6 of the ventilating and air-conditioning apparatus is placed under the roof of bathroom 3.

Main unit 6 is connected with exhausting duct 7 which connects main unit 6 to the outdoors, exhausting duct 9 which connects evacuating port 8 open to a ceiling of dressing room 4 to main unit 6, and exhausting duct 11 which connects evacuating port 10 open to a ceiling of toilet room 5 with main unit 6. Ventilating fan 12 is placed inside main unit 6, and is connected with exhausting duct 7 at its blowout side, exhausting ducts 9 and 11 at its sucking side.

When ventilating fan 12 is driven, the air in dressing room 4 and toilet room 5 is sucked by fan 12 from evacuating ports 8 and 10 through exhausting ducts 9 and 11, and the air is evacuated to the outdoors through exhausting duct 7. A continuous run of fan 12 prompts living room 1 to fall into a negative pressure, so that fresh air is supplied from the outdoors through air-supply port 13 open to the outdoors of living room 2 through a wall. Living space 1 is thus ventilated.

If the ventilating and air-conditioning apparatus discussed above is placed in a highly air-tight building, the ventilating operation needs to be done continuously (around-the-clock ventilation). Ventilating fan 12 thus runs continuously in order to obtain a predetermined ventilation amount, e.g. an hourly ventilation amount corresponding to a volume half of living space 1. Living room 2 is equipped with air-conditioner 14 which cools room 2 in summer or heats room 2 in winter so that a room temperature can be maintained appropriately.

A continuous ventilation throughout the year allows the air cooled down by air-conditioner 14 to a low temperature in summer or the air heated to a high temperature in winter to be sucked into evacuating ports 8 and 10 through a lover or an undercut of door 15 of dressing room 4, or those of door 16 of toilet room 5. The air is then evacuated to the outdoors through main unit 6 of the ventilating and air-conditioning apparatus.

Figure 2:
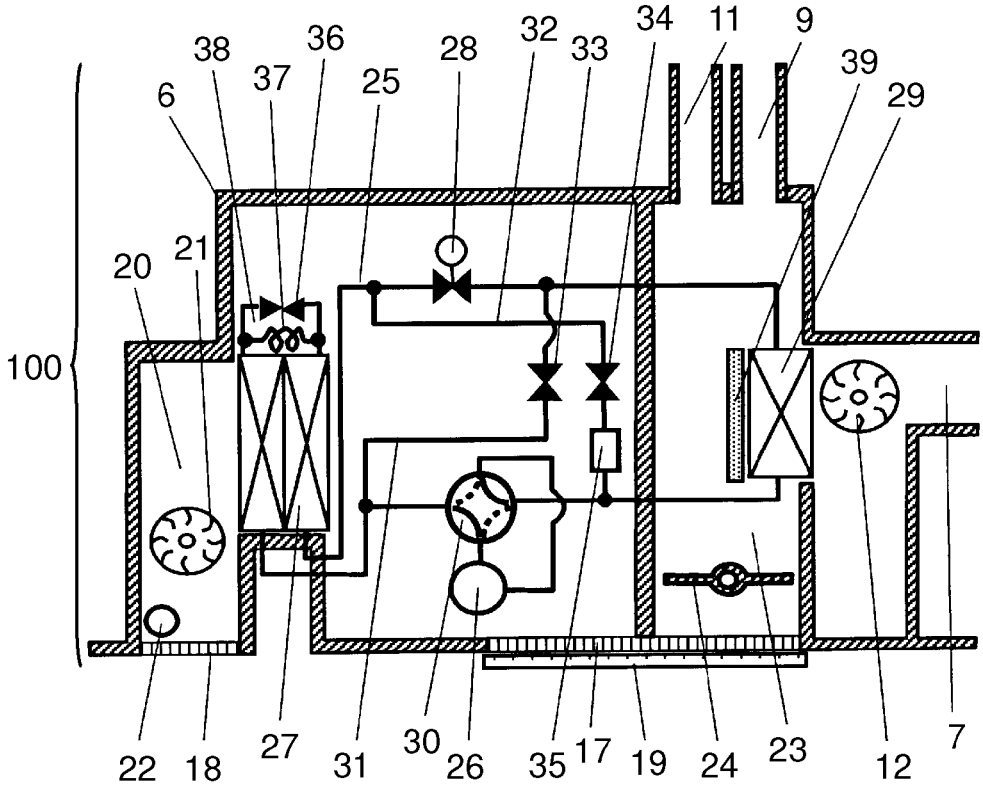
FIG. 2 shows an air course structure and a refrigerant circuit of the ventilating and air-conditioning apparatus.

FIG. 2 shows an air course structure and a refrigerant circuit of the ventilating and air-conditioning apparatus. As shown in FIG. 2, main unit 6 of ventilating and air-conditioning apparatus 100 is placed under the roof of bathroom 3. Main unit 6 includes sucking port 17 and blowout port 18 at its underside both, and both of ports 17 and 18 are open to the ceiling of bathroom 3. Filter 19 is placed on port 17 detachably for catching dust.

Main unit 6 includes circulation path 20 therein for connecting sucking port 17 to blowout port 18, and circulating fan 21 is placed inside path 20 for sucking the air in bathroom 3 from sucking port 17 and blowing out the air from blowout port 18.

Radiation type auxiliary heater 22 is placed around blowout port 18 placed in circulation path 20 for heating at least a part of the air blown by circulating fan 21. Auxiliary heater 22 is placed such that it can dissipate the heat radiated by itself into bathroom 3. Main unit 6 also includes ventilation path 23 therein for connecting sucking port 17 to a sucking side of ventilating fan 12, and path 23 is connected with exhausting duct 9 communicating with dressing room 4, and with exhausting duct 11 communicating with toilet room 5.

Ventilation path 23 includes shutter 24 at its course between sucking port 17 in path 23 and the sucking side of ventilating fan 12. Shutter 24 is equipped with a damper mechanism for opening/closing ventilation path 23. During the operation of ventilating fan 12, when shutter 24 is set to open path 23, air is sucked into main unit 6 through sucking port 17, and exhausting ducts 9, 11. When shutter 24 is set to close path 23, the air can be sucked from exhausting ducts 9, 11. The air thus sucked by ventilating fan 12 is then evacuated to the outdoors through exhausting duct 7 coupled to the blowout side of ventilating fan 12.

Refrigerant circuit 25 is formed in main unit 6. Circuit 25 is filled with one of the following refrigerants: HCFC based refrigerant (its molecule contains atoms of chlorine, hydrogen, fluorine, carbon), HFC based refrigerant (its molecule contains atoms of hydrogen, carbon, fluorine), carbon hydride, and carbon dioxide (natural refrigerant). In this refrigerant circuit 25, the following elements are placed: compressor 26 for compressing the refrigerant, first heat exchanger 27 for exchanging heat between supplied air and the refrigerant, expanding mechanism 28 formed of electronic expanding valve for expanding the refrigerant, and second heat exchanger 29 for exchanging heat between the supplied air and the refrigerant.

Flow path switching valve 30 is placed in refrigerant circuit 25, and switching valve 30 switches a heating cycle to a cooling cycle. To be more specific, during the heating cycle, the refrigerant compressed by compressor 26 flows in circuit 25 this order: first heat exchanger 27, expanding mechanism 28, second heat exchanger 29, and returns to compressor 26. During the cooling cycle, the refrigerant compressed by compressor 26 flows to second heat exchanger 29, expanding mechanism 28, first heat exchanger 27, then returns to compressor 26.

On top of that, bypass circuit 31 is formed in refrigerant circuit 25, and bypass circuit 31 branches off from a pipe which connects flow-path switching valve 30 to first heat exchanger 27, and merges to a pipe which connects expanding mechanism 28 to second heat exchanger 29. Another bypass circuit 32 is also formed in refrigerant circuit 25, and bypass circuit 32 branches off from a pipe which connects first heat exchanger 27 to expanding mechanism 28, and merges into a pipe which connects second heat exchanger 29 to flow-path switching valve 30. In bypass circuit 31, first on-off valve 33 for opening/closing circuit 31 is placed. In bypass circuit 32, second on-off valve 34 for opening/closing circuit 32 and refrigerant heating device 35 are placed. Refrigerant heating device 35 can employ a refrigerant heater, or a refrigerant-hydrothermal exchanger described later.

First heat exchanger 27 is placed in circulation path 20, and second heat exchanger 29 is placed on the sucking side of ventilating fan 12 placed in ventilation path 23. The refrigerant in first heat exchanger 27 thus radiates or absorbs heat to/from the air circulated by circulating fan 21 in bathroom 3. The refrigerant in second heat exchanger 29 absorbs or radiates heat from/to the air evacuated by ventilating fan 12 to the outdoors.

The refrigerant of first heat exchanger 27 flows in the pipe in which decompressing device 38 formed of third on-off valve 36 and capillary tube 37 are placed. First heat exchanger 27 is placed such that when the flow direction of the refrigerant is switched to the heating cycle, i.e. along the solid line of flow-path switching valve 30, the air in bathroom 3 circulated by circulating fan 21 exchanges heat with the refrigerant flowing downstream of decompressing device 38, and then exchanges heat with the refrigerant flowing upstream of decompressing device 38.

In ventilation path 23, pre-heater 39 capable of self-controlling its temperature is placed at the windward side of second heat exchanger 29. When pre-heater 39 works, the air sucked from dressing room 4, the air in toilet room 5 and the air in bathroom 3 into ventilation path 23 can be pre-heated before being supplied to second heat exchanger 29.

Figure 3:
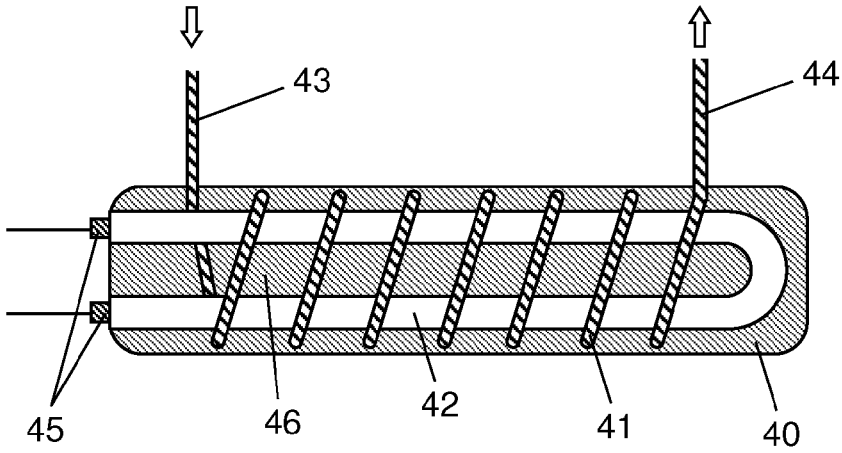
FIG. 3 schematically shows a refrigerant heater to be employed in a refrigerant heating device of the ventilating and air-conditioning apparatus.

FIG. 3 schematically shows a refrigerant heater to be employed in refrigerant heating device 35. As shown in FIG. 3, refrigerant heater 40 is formed of refrigerant conduit 41, electric-heat pipe 42, and heat conductive cylinder 46. Refrigerant conduit 41 is formed by winding a refrigerant pipe, through which the refrigerant ravels, into a coil shape, and heat pipe 42 is shaped like a letter "U" and placed inside the coil shaped refrigerant conduit 41. Heat conductive cylinder 46 is a solid cylinder (not hollow one) and made of metal such as aluminum. Cylinder 46 covers entire surface of heater 40 except inlet 43, outlet 44 of refrigerant conduit 41, and terminals 45 of heat pipe 42.

An application of a given voltage to terminals 45 of electric-heat pipe 42 prompts pipe 42 to generate heat, which then travels in heat conductive cylinder 46 for heating refrigerant conduit 41 placed on a perimeter of heat pipe 42. The refrigerant is input at inlet 43 of refrigerant conduit 41, and flows in conduit 41 at the coil shaped section of which outer wall is covered with heat conductive cylinder 46. At this time the refrigerant is heated via heat conductive cylinder 46, and then the refrigerant arrives at outlet 44. Refrigerant heater 40 heats the refrigerant as discussed above, and heat pipe 42 placed at the core section of heat conductive cylinder 46 generates the heat to refrigerant conduit 41 placed along the perimeter of heat pipe 42. This structure allows reducing the leak of the heat to the outside. The heat generated by heat pipe 42 travels along heat conductive cylinder 46. As a result, refrigerant conduit 41 can be heated uniformly by the heat generated by electric-heat pipe 42, and a heating efficiency can be improved, which allows downsizing refrigerant heating device 35.

Figure 4:
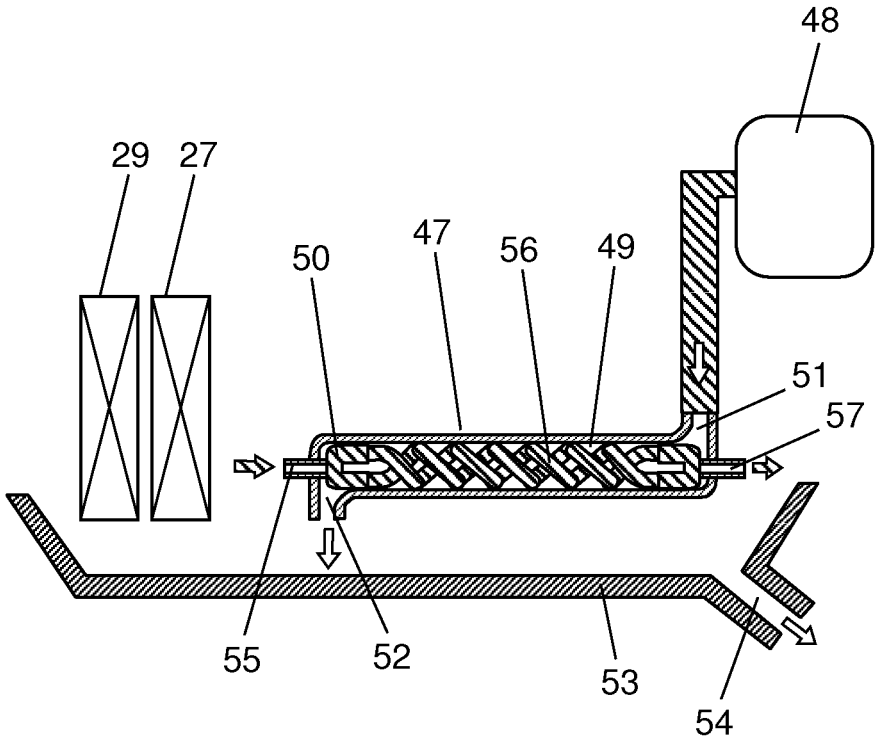
FIG. 4 shows a sectional view schematically illustrating a refrigerant-hydrothermal exchanger of the ventilating and air-conditioning apparatus.

FIG. 4 shows a sectional view schematically illustrating a structure of refrigerant-hydrothermal exchanger to be used in refrigerant heating device 35. As shown in FIG. 4, exchanger 47 employs a dual-pipe construction in which refrigerant conduit 50 is placed within hot-water supply conduit 49 where the hot water supplied from heat-pump type water-heater 48 flows.

Refrigerant conduit 50 is branched off into two lines in hot-water conduit 49, and each one of the branched lines are spirally twisted together so that a heat conductive area can be enlarged for improving a heat exchange efficiency. The hot water enters from inlet 51 into refrigerant-hydrothermal exchanger 47 flows along the perimeter of refrigerant conduit 50 and flows out from outlet 52 to the outside of exchanger 47 and drops to drain-pan 53 placed under outlet 52.

This drain-pan 53 also receives drain-water of the dew formed on first and second heat exchangers 27, 29. The hot water dropped onto drain pan 53 together with the drain water of the dew is evacuated to the outside of main unit 6 through drain pipe 54.

The refrigerant entering from refrigerant-inlet 55 into exchanger 47 flows in the respective twisted pipes along the direction opposite to the flow of the hot water, and exchanges the heat with the hot water, so that the refrigerant is heated, and then flows out from refrigerant-outlet 57. The hot water used in heating the refrigerant is heated by using the atmospheric heat in heat-pump type water-heater 48, so that the heating efficiency of refrigerant heating device 35 can be improved, and the running cost of device 35 can be thus lowered.

Water at an ordinary temperature can be supplied to hot-water conduit 49 instead of the hot water heated to a high temperature by water heater 48. In this case, if flow-path switching valve 30 is switched to the cooling cycle and second on-off valve is set to an open state, the refrigerant compressed by compressor 26 and in a high temperature and a high pressure is supplied to refrigerant conduit 50. The refrigerant can be thus cooled in exchanging heat with the water at the ordinary temperature.

Next, working of ventilating and air-conditioning apparatus 100 is demonstrated hereinafter. FIG. 5 shows a list including working states in response to respective work patterns. The list shows the respective work patterns of air-conditioning apparatus 100 in the columns sequentially, and working states of major structural elements in response to the work patterns in the rows.

Ventilating and air-conditioning apparatus 100 can perform 6 patterns as listed in FIG. 5, namely, "around-the-clock ventilation", "dry", "dehumidify", "cool", "pre-heat", and "heat for bathing". The work pattern of "around-the-clock ventilation" carries out ventilation for 24 hours/day continuously in order to obtain a ventilated amount of the air necessary for living space 1. During the operation of this pattern, ventilating fan 12 is set to a weak notch which assures the necessary ventilation amount, and shutter 24 placed in ventilation path 23 is set to the "open" state. Other major structural elements including circulating fan 21, compressor 26, auxiliary heater 22, pre-heater 39, and refrigerant heating device 35 are all set to "halt" state. A predetermined amount of the air corresponding to a necessary amount of air is thus sucked from sucking port 17 open to bathroom 3, evacuating port 8 open to dressing room 4, and evacuating port 10 open to toilet room 5 into ventilating fan 12 through ventilation path 23, and then the air is evacuated to the outdoors. An amount of fresh air corresponding to the amount of the evacuated air is taken into air-supply port 13 open to living room 2. The air evacuated from living space 1 can be thus replaced with the fresh air, so that living space 1 can be ventilated.

Next, the pattern of "dry" is demonstrated hereinafter. This dry pattern is selected when laundry is hung in bathroom 3 to dry. In the case of carrying out this "dry" pattern, ventilating fan 12 is set to a strong notch which gives a greater wind volume than that of the "around-the-clock ventilation" operation, shutter 24 is set to the open state, and circulating fan 21 is set to a given notch which drives fan 21 at a wind volume set by a user. Then compressor 26 is driven.

Flow-path switching valve 30 is set to the "heating cycle", expanding mechanism 28 is set its electronic expanding valve to a given open angle, first on-off valve 33 placed in bypass circuit 31 is set to the closed state, second on-off valve 34 placed in bypass circuit 32 is set to the closed state, third on-off valve 36 placed in the refrigerant conduit is set to the open state, and other elements including auxiliary heater 22, pre-heater 39, refrigerant heating device 35 are set to the halt state. The foregoing settings allow the refrigerant, compressed by compressor 26 and in a high temperature and a high pressure state, to flow through flow-path switching valve 30 set to the heating cycle, and then, to arrive at first heat exchanger 27 because first on-off valve 33 is set to the closed state. In first heat exchanger 27, circulating fan 21 works at the given notch, so that the air sucked from bathroom 3 through sucking port 17 into main unit 6 is supplied to first heat exchanger 27.

Since third on-off valve 36 is set to the open state, the refrigerant in a high temperature and a high pressure state and entering into first heat exchanger 27 passes through exchanger 27 free from an extreme decompressing action. At this time, the refrigerant exchanges heat with the supplied air, i.e. the refrigerant radiates heat for heating the air, which is then blown out from blowout port 18 into bathroom 3. The entire refrigerant having radiated the heat in first heat exchanger 27 arrives at expanding mechanism 28 because second on-off valve 34 is set to the open state. The refrigerant is then decompressed and expands when the refrigerant passes the electronic expanding valve which is set to a given open angle, and then arrives at second heat exchanger 29.

In second heat exchanger 29, since ventilating fan 12 works at the strong notch, the air in dressing room 4 and toilet room 5 is supplied to second heat exchanger 29 via exhausting ducts 9 and 11. Since shutter 24 is set to the open state, the air in bathroom 3 travels from sucking port 17 to second heat exchanger 29 via ventilation path 23. The mechanics discussed above allows the refrigerant in second heat exchanger 29 to absorb heat from the air supplied from bathroom 3, the air supplied from dressing room 4, and the air supplied from toilet room 5.

The refrigerant having absorbed the heat in second heat exchanger 29 returns to compressor 26 via flow-path switching valve 30, so that the refrigerant resultantly circulates through refrigerant circuit 25. The heat of the air supplied to second heat exchanger 29 is absorbed by the refrigerant. Thereby, the enthalpy of the air is reduced. Finally, the air is evacuated to the outdoors from exhausting duct 7.

The laundry is hung in bathroom 3 during the dry operation discussed above, then the air heated to a high temperature by first heat exchanger 27 circulates in bathroom 3 and promotes evaporation of water from the laundry. The air in bathroom 3 traps the water evaporated from the laundry and is sucked into main unit 6 by ventilating fan 12, and then collected its heat by second heat exchanger 29 before the air is evacuated to the outdoors. On top of that, second heat exchanger 29 receives a greater amount of air than the air amount supplied thereto during the around-the-clock ventilation operation, so that the refrigerant can absorb a greater amount of heat. As a result, the refrigerant can dissipate a greater amount of heat, thereby drying the laundry quickly.

Next, the "dehumidify" operation is demonstrated hereinafter. The "dehumidify" pattern is selected in dehumidifying bathroom 3, e.g. after taking a bath, in order to prevent bathroom 3 from going moldy. In the case of carrying out the "dehumidify" operation, ventilating fan 12 is set to the weak notch which is able to obtain a necessary amount of ventilation air, shutter 24 is set to the closed state, circulating fan 21 is set to a predetermined notch at which fan 21 works with the air volume set by a user. Then compressor 26 is driven. Flow-path switching valve 30 is set to the heating cycle, first on-off valve 33 is set to the closed state, second on-off valve 34 is set to the open state, and third on-off valve 36 is set to the closed state. Other elements including auxiliary heater 22, pre-heater 39, and refrigerant heating device 35 are set to the halt state.

The foregoing settings allow the refrigerant compressed by compressor 26 and in a high temperature and a high pressure flows through flow-path switching valve 30 set to the heating cycle, and then the entire refrigerant arrives at first heat exchanger 27 because first on-off valve 33 is set to the closed state. In first heat exchanger 27, circulating fan 21 works at the given notch, so that the air sucked from sucking port 17 into main unit 6 is supplied to bathroom 3.

Since third on-off valve 36 is set to the closed state, the refrigerant at a high temperature and a high pressure and entering into first heat exchanger 27 is decompressed by capillary tube 37 and expands, and then the refrigerant at a low temperature and at a low pressure passes in the remaining refrigerant conduit. The air of bathroom 3 flows into circulation path 20, and is firstly supplied to the downstream side of capillary tube 37 of first heat exchanger 27. The refrigerant absorbs heat from the supplied air at this downstream side, so that the supplied air is cooled and dehumidified.

The cooled and dehumidified air of bathroom 3 is then supplied to the upstream side of capillary tube 37 of first heat exchanger 27, where the refrigerant radiates heat to the supplied air of low temperature and low humidity, so that the air increases its temperature only. The air thus becomes dry air at a high temperature and a low humidity, and returns to bathroom 3 via blowout port 18. Repeating the foregoing air circulation will make bathroom 3 an environment of high temperature and low humidity, namely, bathroom 3 is dehumidified.

The refrigerant having radiated and absorbed the heat to/from the supplied air in first heat exchanger 27 flows entirely toward bypass circuit 32 because the first on-off valve 33 is set to the closed state, and second on-off valve 34 is set to the open state. The refrigerant then returns to compressor 26 via flow-path switching valve 30. The refrigerant resultantly circulates through refrigerant circuit 25. Ventilating fan 12 is driven at the weak notch which is capable of supplying an air volume necessary for ventilating the living space 1. Since shutter 24 is set to the closed state, only the air in dressing room 4 and toilet room 5 can be sucked by ventilating fan 12 via exhausting ducts 9 and 11, and the air is evacuated to the outdoors.

The mechanics discussed above allows supplying fresh air corresponding to the necessary ventilation volume to living space 1. The fresh air is sucked from air-supply port 13, so that the ventilation is carried out. The dry air of high temperature and low humidity and dehumidified in circulation path 20 cannot be evacuated outside bathroom 3, thereby preventing the dehumidifying efficiency from decreasing.

Next, the "cool" operation is demonstrated hereinafter. The "cool" pattern is selected when a user in bathroom 3 wants to lower a high temperature, e.g. in summer, for cooling bathroom 3 in order to take a bath pleasantly, or clean bathroom 3 lightly.

In the case of carrying out this "cool" operation, ventilating fan 12 is set to a strong notch which gives a greater volume of wind than that of the "around-the-clock ventilation", shutter 24 is set to the closed state, and circulating fan 21 is set to a given notch which drives fan 21 at a wind volume set by a user. Then compressor 26 is driven. Flow-path switching valve 30 is set to "cooling cycle", expanding mechanism 28 is set its electronic expanding valve to a given open angle, first on-off valve 33 is set to the closed state, second on-off valve 34 is set to the closed state, third on-off valve 36 is set to the open state, and other elements including auxiliary heater 22, pre-heater 39, refrigerant heating device 35 are set to the halt state.

The settings discussed above allow the refrigerant compressed by compressor 26 and in a high temperature and a high pressure state to flow through flow-path switching valve 30 set to the cooling cycle, and then the entire refrigerant arrives at second heat exchanger 29 because second on-off valve 34 is set to the closed state. In second heat exchanger 29, ventilating fan 12 works at the strong notch, so that the air in dressing room 4 and toilet room 5 is supplied to second heat exchanger 29 through exhausting ducts 9 and 11, and the refrigerant radiates heat to the supplied air. The temperature of the air sucked from dressing room 4 and toilet room 5 becomes high due to the heat radiation from the refrigerant, and the air is evacuated to the outdoors through exhausting duct 7. The refrigerant having radiated the heat in second heat exchanger 29 entirely arrives at expanding mechanism 28 because first on-off valve 33 is set to the closed state. The refrigerant is then decompressed and expands when it passes the electronic expanding valve before it arrives at first heat exchanger 27.

In first heat exchanger 27, circulating fan 21 works at the given notch, so that the air sucked from bathroom 3 through sucking port 17 to main unit 6 is supplied to first heat exchanger 27, and the refrigerant absorbs heat from this supplied air. The refrigerant then returns to compressor 26 via flow-path switching valve 30. The refrigerant thus resultantly circulates through refrigerant circuit 25. The temperature of the air supplied to first heat exchanger 27 becomes low due to the heat absorption by the refrigerant, and returns to bathroom 3 through blowout port 18. The air circulation discussed above is repeated, thereby lowering the temperature in bathroom 3, which is thus cooled.

Shutter 24 is set to the closed state, so that the air cooled to a low temperature in circulation path 20 cannot be evacuated to the outside of bathroom 3. The foregoing mechanics thus prevent an air-conditioning efficiency from lowering.

If a user encounters an extraordinary high temperature in summer, the air is supplied at a high temperature to second heat exchanger 29, so that the refrigerant cannot radiates enough heat, thereby sometimes causing a lack of cooling power. In such a case, water at an ordinary temperature instead of hot water can be supplied to hot-water conduit 49 of refrigerant-hydrothermal exchanger 47 as discussed previously, and second on-off valve 34 is set to the open state. Then the refrigerant compressed by compressor 26 and in a high pressure and a high temperature state is circulated through exchanger 47 for the refrigerant to radiate heat to the water at an ordinary temperature. This mechanics allows preventing the cooling power from lowering.

Next, the "pre-heat" operation is demonstrated hereinafter. The "pre-heat" pattern is selected for heating bathroom 3 before a user take a bath in a low-temperature season like winter so that a heat shock can be softened. In the case of carrying out the "pre-heat" operation, ventilating fan 12 is set to the strong notch which gives a greater wind volume than that of the "around-the-clock ventilation", shutter 24 is set to the open state, and circulating fan 21 is set to the given notch which drives fan 21 at a wind volume set by a user. Then compressor 26 is driven. Flow-path switching valve 30 is set to the "heating cycle", expanding mechanism 28 is set its electronic expanding valve to a given open angle, first on-off valve 33 is set to the closed state, second on-off valve 34 is set to the closed state, third on-off valve 36 is set to the open state, and other elements including auxiliary heater 22, pre-heater 39, refrigerant heating device 35 are set to the halt state.

The settings discussed above allow the refrigerant compressed by compressor 26 and in a high temperature and a high pressure state to flow through flow-path switching valve 30 set to the heating cycle, and then the entire refrigerant arrives at first heat exchanger 27 because first on-off valve 33 is set to the closed state. In first heat exchanger 27, circulating fan 21 works at the given notch, so that the air sucked from bathroom 3 through sucking port 17 into main unit 6 is supplied to first heat exchanger 27.

Since third on-off valve 36 is set to the open state, the refrigerant at a high temperature and a high pressure enters into first heat exchanger 27 and passes through exchanger 27 free from a decompressing action. At this time, the refrigerant exchanges heat with the air sucked from bathroom 3 and supplied to exchanger 27, i.e. the refrigerant radiates heat for heating the air, which is then blown out from blowout port 18 to bathroom 3.

The entire refrigerant having radiated heat in first heat exchanger 27 arrives at expanding mechanism 28 because second on-off valve 34 is set to the closed state. The refrigerant is then decompressed and expands when the refrigerant passes the electronic expanding valve which is set to the given open angle, and then arrives at second heat exchanger 29. Since ventilating fan 12 works at the strong notch in second heat exchanger 29, the air in dressing room 4 and toilet room 5 is supplied to second heat exchanger 29 via exhausting ducts 9 and 11. The refrigerant absorbs heat from the supplied air.

The refrigerant having absorbed the heat in second heat exchanger 29 returns to compressor 26 via flow-path switching valve 30, so that the refrigerant resultantly circulates through refrigerant circuit 25. The heat in air supplied to second heat exchanger 29 is absorbed by the refrigerant. Thereby, the enthalpy of air is reduced. Finally, the air is evacuated to the outdoors through exhausting duct 7. The foregoing operation raises the temperature in bathroom 3, which is thus pre-heated. Shutter 24 is set to the closed state, so that the air heated in circulation path 20 to a high temperature cannot be evacuated to the outside of bathroom 3. The foregoing mechanism thus prevents an air-conditioning efficiency from lowering.

When a user encounters an extraordinary low temperature in winter, the air sucked by ventilating fan 12 from dressing room 4 and toilet room 5 and supplied to second heat exchanger 29 lowers its temperature, so that second heat exchanger 29 is sometimes frosted during the pre-heat operation discussed above. If the frost is left as it is, second heat exchanger 29 lowers its heat absorption power, and this phenomenon entails that first heat exchanger 27 reduces its heat radiation amount, so that bathroom 3 cannot be sufficiently heated.

In order to prevent the foregoing problem, the following measures should be taken: Monitor the temperature of the refrigerant conduit in second heat exchanger 29 during the pre-heat operation, and carry out a frost-removal operation for removing the frost attached to second heat exchanger 29 if the temperature lowers to a predetermined temperature.

The frost removal operation is demonstrated hereinafter. In the case of carrying out the frost removal operation during the pre-heat, both of ventilating fan 12 driven at the strong notch and circulating fan 21 driven at the given notch are halted. Then flow-path switching valve 30 set to the heating cycle is switched over to the cooling cycle.

These settings allows the refrigerant compressed by compressor 26 and in a high pressure and a high temperature state to flow through flow-path switching valve 30 which has been switched over to the cooling cycle, and to arrive at second heat exchanger 29. This refrigerant at the high temperature flows through the refrigerant conduit in second heat exchanger 29, so that a temperature of the conduit rises, thereby melting the frost attached to the conduit surface. The melted frost drops as draining water to drain-pan 53, and is evacuated to the outside of bathroom 3 via drain pipe 54.

The refrigerant which has radiated heat in second heat exchanger 29 for melting the frost flows through expanding mechanism 28, first heat exchanger 27, and flow-path switching valve 30 in this order, and then returns to compressor 26. The refrigerant thus resultantly circulates through refrigerant circuit 25. A continuous operation of the foregoing frost-removing operation will completely melt the frost attached to second heat exchanger 29, so that the conduit raises its temperature. The temperature of the conduit is monitored continuously, and when it rises to a predetermined value, the frost-removal operation is switched again to the pre-heat operation. The foregoing process allows preventing the heating power from extremely lowering during a low temperature period, and allows performing a sufficient pre-heat.

Next, the "heat for bathing" operation is demonstrated hereinafter. This pattern is selected for heating bathroom 3 when a user washes himself or herself in bathroom 3 during a low-temperature season like in winter so that the user can take a bath comfortably without feeling the cold.

The settings and operation of this "heat for bathing" is basically the same as those of "pre-heat" operation. However, auxiliary heater 22 can be switched between "operate" and "halt" in response to a user's choice. For instance, when the user feels drawing a draft, and the user thus sets circulating fan 21 to a smaller air volume. Then the user feels a smaller amount of the draft although the refrigerant reduces its heat radiation because the air volume supplied to first heat exchanger 27 is reduced. As a result, the temperature in bathroom 3 lowers, which incurs a loss of the amenity. In such a case, drive of auxiliary heater 22 will further heat the air passed through first heat exchanger 27 to a high temperature, so that the temperature in bathroom 3 can be suppressed to lower.

On top of that, when auxiliary heater 22 employs a radiant heater, the heater irradiates radiant heat directly to a human body, who can feel more warmth. The foregoing operation allows users to take a bath comfortably without feeling the cold.

During the "heat for bathing" operation, the frost-removal operation similar to that carried out during the "pre-heat" operation is needed for removing the frost attached to second heat exchanger 29. Since a user exists in bathroom 3 during the "heat for bathing" operation, the "heat" operation is preferably maintained during the "frost removal" operation although during the "pre-heat" operation the "heat" operation is temporarily halted before the "frost removal" operation starts.

The "frost removal" operation during the "heat for bathing" operation is demonstrated hereinafter: Ventilating fan 12, shutter 24, circulating fan 21, compressor 26 and flow-path switching valve 30 maintain their workings of the "heat for bathing" operation, although first on-off valve 33 and second on-off valve 34 are switched from the closed states to the open state. The electronic expanding valve of expanding mechanism 28 is set to a full-closed state, and then pre-heater 39 and refrigerant heating device 35 are driven.

The settings thus changed as discussed above allows the refrigerant compressed by compressor 26 and in a high pressure and a high temperature state to pass through flow-path switching valve 30 set to the heating cycle, and to branch off toward first heat exchanger 27 and toward bypass circuit 31, because first on-off valve 33 has been switched to the open state. The refrigerant branched off toward first heat exchanger 27 radiates heat to the air sucked from bathroom 3 by circulating fan 21 and supplied to exchanger 27. The air heated by the heat radiation from the refrigerant circulates in bathroom 3, so that the heat operation is maintained.

The refrigerant having radiated heat to the supplied air in first heat exchanger flows entirely to bypass circuit 32 and enters into refrigerant heating device 35 because the electronic expanding valve of expanding mechanism 28 is set to the full-closed state and second on-off valve 34 is set to the open state. Refrigerant heating device 35 is equipped with refrigerant heater 40 or refrigerant-hydrothermal exchanger 47, so that the refrigerant is heated by device 35, i.e. the refrigerant absorbs heat.

On the other hand, the high-temperature and high-pressured refrigerant, which has been discharged from compressor 26 and branched off toward bypass circuit 31, flows into second heat exchanger 29. Since ventilating fan 12 in exchanger 29 operates at the strong notch, the air sucked from dressing room 4 and toilet room 5 is supplied to second heat exchanger 29 via exhausting ducts 9 and 11. This supplied air is heated by pre-heater 39 placed on the upstream side of exchanger 29 before it enters into exchanger 29 at a higher temperature.

In second heat exchanger 29, the high-temperature refrigerant thus flows in the refrigerant conduit, and the high-temperature air heated by pre-heater 39 flows along the conduit surface where frost attaches. The frost attached to second heat exchanger 29 can be thus removed quickly. The refrigerant having melted the frost attached to exchanger 29 flows together with the other refrigerant heated by refrigerant heating device 35, and returns to compressor 26 via flow-pass switching valve 30. The air supplied to exchanger 29 radiates heat to the frost attached, and then is evacuated to the outdoors via exhausting duct 7.

As discussed above, the frost-removal of second heater exchanger 29 can be achieved while the "heat for bathing" operation is maintained. When a pipe temperature of exchanger 29 rises to the given value, i.e. when the frost-removal is completed, the operation returns to the regular "heat for bathing" operation so that the "heat" operation can be continuously carried out free from losing user's comfortable feeling.

The structure and working discussed above prove that the ventilating and air-conditioning apparatus for a bathroom in accordance with the first embodiment of the present invention produces the following advantages.

In second heat exchanger 29, the refrigerant absorbs heat from the air which is sucked from dressing room 4 and toilet room 5 and is to be evacuated by ventilating fan 12 to the outdoors. In first heat exchanger 27, the refrigerant radiates heat to the air circulated by circulating fan 21 in bathroom 3. A heat pump starts working with a heat source using the air sucked from dressing room 4 and toilet room 5 and to be evacuated to the outdoors, so that bathroom 3 is heated. The air heated by first heat exchanger 27 thus does not leak outside bathroom 3, which can be thus effectively heated, and the thermal efficiency can be improved.

On top of that, the structural elements of refrigerant circuit 25, i.e. they are compressor 26, first heat exchanger 27, expanding mechanism 28, and second heat exchanger 29, can be accommodated in ventilating and air-conditioning apparatus 100 installed under the roof of bathroom 3. This structure allows achieving space-saving and improving the installing work of air-conditioning apparatus 100.

In second heat exchanger 29, the refrigerant radiates heat to the air sucked from dressing room 4 and toilet room 5 and to be evacuated to the outdoors by ventilating fan 12. In first heat exchanger 27, the refrigerant absorbs heat from the air circulating in bathroom 3 by circulating fan 21. This circulating air works as heat source of the heat pump, which then cools bathroom 3. The air cooled by first heat exchanger 27 will not leak outside bathroom 3, which can be thus cooled effectively. The thermal efficiency can be thus improved.

The foregoing air circulating in bathroom 3 is absorbed of its heat at the downstream side of decompressing device 38 of first heat exchanger 27, and then this air radiates its heat at the upstream side of decompressing device 38, so that bathroom 3 can be dehumidified. As a result, the air dehumidified by first heat exchanger 27 does not leak from bathroom 3, so that bathroom can be dehumidified effectively.

When bathroom 3 is air-conditioned, a greater wind volume can be used than a wind volume used for ventilating the dressing room 4 and toilet room 5. This increment in the wind volume allows second heat exchanger 29 to absorb or radiate a greater amount of heat, so that a sufficient air-conditioning power can be obtained.

The air conditioned by air-conditioner 14 installed outside bathroom 3 is sucked from evacuating ports 8 and 10 and supplied to second heat exchanger 29, so that the thermal energy produced outside bathroom 3 by air-conditioner 14 can be collected. Further improvement in the thermal efficiency thus can be expected.

The presence of ventilation path 23, which connects bathroom 3 to the suction side of ventilating fan 12, and shutter 24 which opens or closes ventilation path 23 allows achieving an efficient air-conditioning of bathroom 3 by setting shutter 24 to the closed state for preventing the conditioned air from being exhausted. Setting shutter 24 to the open state allows quick evacuation of the air from bathroom 3, so that bathroom 3 can be ventilated and dried.

In the case of drying bathroom 3, the refrigerant absorbs heat from the air which flows through ventilation path 23 in second heat exchanger 29 and is to be evacuated to the outdoors, so that the heat radiated to the air of bathroom 3 in first heat exchanger 27 can be collected. As a result, drying efficiency can be improved.

Ventilation path 23 can communicate with bathroom 3 via sucking port 17, so that a sucking section of ventilation path 23 can work also as sucking port 17. As a result, the number of dust filters can be reduced.

Auxiliary heater 22 can heat at least parts of the air blown by circulating fan 21, so that the heating power in a low-temperature environment can be reinforced.

Auxiliary heater 22 disperses its radiant heat in bathroom 3, thereby reducing the feeling of drawing a draft when a user takes a bath, and increasing the amenity of bathroom 3.

Pre-heater 39 pre-heats the air to be supplied to second heat exchanger 29, whereby the heating power in the low-temperature environment can be prevented from lowering and the frost can be prevented from attaching to second heat exchanger 29. This pre-heat is also useful for removing the frost attached to exchanger 29.

When the frost attaches to first heat exchanger 27 or second heat exchanger 29 in the low-temperature environment, flow-path switching valve 30 is switched based on a temperature of the refrigerant for removing the frost.

When the frost attaches to second heat exchanger 29 in the low-temperature environment, refrigerant circuit 25 is opened at its high pressure side and its low pressure side via bypass circuit 31 or bypass circuit 32. This preparation allows the refrigerant at a high-temperature to flow through second heat exchanger 29 or a pressure of the refrigerant in exchanger 29 to be raised for removing the frost.

Refrigerant heating device 35 is placed in refrigerant circuit 25 such that device 35 is in series with or in parallel with second heat exchanger 29. When second heat exchanger 29 lowers its heat absorption power due to, e.g. the frost attaching thereto, this refrigerant heating device 35 is activated, so that the heat absorption power as well as heating power can be maintained.

Use of refrigerant heater 40, which heats the refrigerant with electric heat, as refrigerant heating device 35 allows downsizing device 35.

Use of refrigerant-hydrothermal exchanger 47, which heats the refrigerant by exchanging heat with the heated water, as refrigerant heating device 35 allows saving electric power.

Use of the water heated by a heat-pump type water heater as heated water to be supplied to refrigerant-hydrothermal exchanger 47 allows further saving the electric power of refrigerant heating device 35.

When the water having undergone the heat exchange with the refrigerant is evacuated, use of a drain channel for draining dew water generated on first heat exchanger 27 or second heat exchanger 29 allows not increasing the number of drain channels, so that the installation work can be simplified.

When the heat radiating power becomes short particularly in summer, the refrigerant radiates heat to the ordinary-temperature water supplied to refrigerant-hydrothermal exchanger 47. This structure allows solving the shortage of the heat radiating power and maintaining the cooling power.

Embodiment 2

A ventilating and air-conditioning apparatus in accordance with the second embodiment of the present invention is demonstrated hereinafter. Similar elements to those used in the first embodiment have the same reference marks thereof, and detailed descriptions thereof are omitted. A living space equipped with the ventilating and air-conditioning apparatus in accordance with this second embodiment is the same one as that used in the first embodiment.

FIG. 6 shows an air course structure and a refrigerant circuit of ventilating and air-conditioning apparatus 110 in accordance with the second embodiment of the present invention. As shown in FIG. 6, main unit 6 of ventilating and air-conditioning apparatus 110 is installed under the roof of bathroom 3, which is a first indoor space. Air-conditioning apparatus 110 differs from air-conditioning apparatus 100 of the first embodiment in the following points:

Ventilating and air-conditioning apparatus 110 includes temperature sensor 58 around sucking port 17 for sensing a temperature in bathroom 3. Main unit 6 includes controller 59 therein for controlling circulating fan 21, ventilating fan 12, compressor 26 and flow-path switching valve 30. Controller 59 controls the rpm of circulating fan 21 and ventilating fan 12, and carries out stopping compressor 26, switching flow-path switching valve 30 according to an instruction supplied from a remote control (not shown) or based on an indication of temperature sensor 58. Controller 59 is formed of a control board wired to sensor 58, fans 21 and 12, compressor 26 and valve 30 respectively.

The working of ventilating and air-conditioning apparatus 110 is demonstrated hereinafter. FIG. 7 lists the working states of respective work patterns. The list shows the respective work patterns of air-conditioning apparatus 110 in the columns sequentially and working states of major structural elements in response to the work patterns in the rows. Ventilating and air-conditioning apparatus 110 can perform 4 patterns as listed, namely, "around-the-clock ventilation", "dry", "cool", and "heat".

The work pattern of "around-the-clock ventilation" carries out ventilation for 24 hours/day continuously in order to obtain a ventilated amount of air necessary for living space 1. During this pattern, ventilating fan 12 is set to a weak notch which assures the necessary ventilation amount, and shutter 24 placed in ventilation path 23 is set to "open state". Other major structural elements including circulating fan 21 and compressor 26 are set to "halt" state.

A predetermined amount of air corresponding to a necessary amount of air for ventilation is thus sucked from sucking port 17 open to bathroom 3, evacuating port 8 open to dressing room 4, and evacuating port 10 open to toilet room 5 into ventilating fan 12 through ventilation path 23, and then the air is evacuated to the outdoors. An amount of fresh air corresponding to the amount of the evacuated air is taken into air-supply port 13 open to living room 2. The air evacuated from living space 1 can be thus replaced with the fresh air, so that living space 1 can be ventilated.

Next, the "dry" operation is demonstrated hereinafter. This dry pattern is selected when laundry is hung in bathroom 3 to dry. In the case of carrying out this "dry" operation, ventilating fan 12 is set to a strong notch which gives a greater wind volume than that of the "around-the-clock ventilation", shutter 24 is set to the open state, and circulating fan 21 is set to a given notch which drives fan 21 at a wind volume set by a user. Then compressor 26 is driven. Flow-path switching valve 30 is set to "heating cycle".

The settings discussed above allow the refrigerant, compressed by compressor 26 and in a high temperature and a high pressure state, to flow through flow-path switching valve 30 set to the heating cycle, and then the refrigerant arrives at first heat exchanger 27. In first heat exchanger 27, circulating fan 21 works at the given notch, so that the air sucked from bathroom 3 through sucking port 17 into main unit 6 is supplied to first heat exchanger 27. In first heat exchanger 27, the refrigerant exchanges heat with the supplied air, i.e. the refrigerant radiates heat for heating the air, which is then blown out from blowout port 18 to bathroom 3.

The refrigerant having radiated the heat in first heat exchanger 27 passes through expanding mechanism 28, i.e. capillary tube, where the refrigerant is decompressed and expands, and then the refrigerant arrives at second heat exchanger 29. Since ventilating fan 12 works at the strong notch in second heat exchanger 29, the air in dressing room 4 and toilet room 5 is supplied to second heat exchanger 29 via exhausting ducts 9 and 11. Since shutter 24 is set to the open state, the air sucked from bathroom 3 via sucking port 17 travels through ventilation path 23 and arrives at second heat exchanger 29.

The refrigerant absorbs heat from the air supplied from bathroom 3, dressing room 4 and toilet room 5. The refrigerant having absorbed the heat in second heat exchanger 29 returns to compressor 26 via flow-path switching valve 30, so that the refrigerant resultantly circulates through refrigerant circuit 25. The air supplied to second heat exchanger 29 is absorbed the heat by the refrigerant, thereby reducing its enthalpy, and is finally evacuated to the outdoors through exhausting duct 7.

The laundry is hung in bathroom 3 during the dry operation discussed above, then the air heated to a high temperature by first heat exchanger 27 circulates in bathroom 3 and promotes evaporation of water from the laundry. The air in bathroom 3 traps the water evaporated from the laundry and is sucked into main unit 6 by ventilating fan 12, and then collected its heat by second heat exchanger 29 before the air is evacuated to the outdoors. On top of that, second heat exchanger 29 receives a greater amount of air than the air amount supplied thereto during the around-the-clock ventilation operation, so that the refrigerant can absorb a greater amount of heat. As a result, the refrigerant can radiate a greater amount of heat, thereby drying the laundry quickly.

Next, the "cool" operation is demonstrated hereinafter. The "cool" pattern is selected when a user in bathroom 3 wants to lower a high temperature, e.g. in summer, for cooling bathroom 3 in order to take a bath pleasantly, or to clean bathroom 3 lightly.

In the case of carrying out this "cool" operation, circulating fan 21 is set to the given notch at which fan 21 produces a wind volume set by a user. Shutter 24 is set to the closed state. Then compressor 26 is driven. Flow-path switching valve 30 is set to "cooling cycle", and the air volume of ventilating fan 12 is set according to a value sensed by temperature sensor 58. Control of fan 12 will be detailed later.

The settings discussed above allow the refrigerant compressed by compressor 26 and in a high temperature and a high pressure state to flow through flow-path switching valve 30 set to the cooling cycle, and then the refrigerant arrives at second heat exchanger 29. In second heat exchanger 29, since ventilating fan 12 works at a given notch set according to the value sensed by temperature sensor 58 discussed later, the air in dressing room 4 and toilet room 5 is supplied to second heat exchanger 29 through exhausting ducts 9 and 11, and the refrigerant radiates heat to the supplied air. The temperature of the air supplied from dressing room 4 and toilet room 5 rises due to the heat radiation from the refrigerant, and then the air is evacuated to the outdoors through exhausting duct 7.

The refrigerant having radiated the heat in second heat exchanger 29 arrives at expanding mechanism 28, and when the air passes through the capillary tube, the refrigerant is decompressed and expands. The refrigerant then arrives at first heat exchanger 27. In first heat exchanger 27, circulating fan 21 works at the given notch, so that the air sucked from bathroom 3 through sucking port 17 to main unit 6 is supplied to first heat exchanger 27, and the refrigerant absorbs heat from this supplied air. The refrigerant having absorbed the heat then returns to compressor 26 via flow-path switching valve 30. The refrigerant thus resultantly circulates through refrigerant circuit 25.

The temperature of the air supplied to first heat exchanger 27 lowers due to the heat absorption by the refrigerant, and returns to bathroom 3 through blowout port 18. The air circulation discussed above is repeated, thereby lowering the temperature in bathroom 3, which is thus cooled. Shutter 24 is set to the closed state, so that the air cooled to a low temperature in circulation path 20 cannot be evacuated to the outside of bathroom 3. The foregoing mechanics thus prevents an air-conditioning efficiency from lowering.

Next, the "heat" operation is demonstrated hereinafter. This pattern is selected for heating bathroom 3 before a user takes a bath. In the heated bathroom 3, a user washes himself or herself comfortably during a low-temperature season like in winter without feeling the cold.

In the case of carrying out this "heat" operation, circulating fan 21 is set to the given notch at which fan 21 produces a wind volume set by a user. Shutter 24 is set to the closed state. Then compressor 26 is driven. Flow-path switching valve 30 is set to "heating cycle", and the air volume of ventilating fan 12 is set according to a value sensed by temperature sensor 58. Control of fan 12 will be detailed later.

These settings allow the refrigerant compressed by compressor 26 and in a high pressure and a high temperature state to pass through flow-path switching valve 30 and arrives at first heat exchanger 27. Since circulating fan 21 is driven at the given notch in first heat exchanger 27, the air sucked from bathroom 3 through sucking port 17 into main unit 6 is supplied to first heat exchanger 27. The refrigerant radiates heat to the supplied air and raises the temperature of the air. This high-temperature air returns to bathroom 3 via blowout port 18. This air circulation is repeated, whereby the temperature is raised in bathroom 3, which is thus heated.

The refrigerant having radiated heat in first heat exchanger 27 arrives at expanding mechanism 28, and when it passes through the capillary tube, the refrigerant is decompressed and expands, and then the refrigerant arrives at second heat exchanger 29. Since ventilating fan 12 works at a notch set according to a value sensed by temperature sensor 58 which is detailed later, the air in dressing room 4 and toilet room 5 is supplied to second heat exchanger 29 via exhausting ducts 9 and 11. The refrigerant absorbs heat from the air supplied from dressing room 4 and toilet room 5. The refrigerant having absorbed the heat in second heat exchanger 29 returns to compressor 26 via flow-path switching valve 30, so that the refrigerant resultantly circulates through refrigerant circuit 25.

The heat in the air supplied to second heat exchanger 29 is absorbed by the refrigerant, thereby reducing its enthalpy, and is finally evacuated to the outdoors through exhausting duct 7. Since shutter 24 is set to the closed state, the air heated to a high temperature in circulation path 20 cannot be evacuated outside bathroom 3, so that the efficiency of air-conditioning is prevented from lowering.

Figure 8:
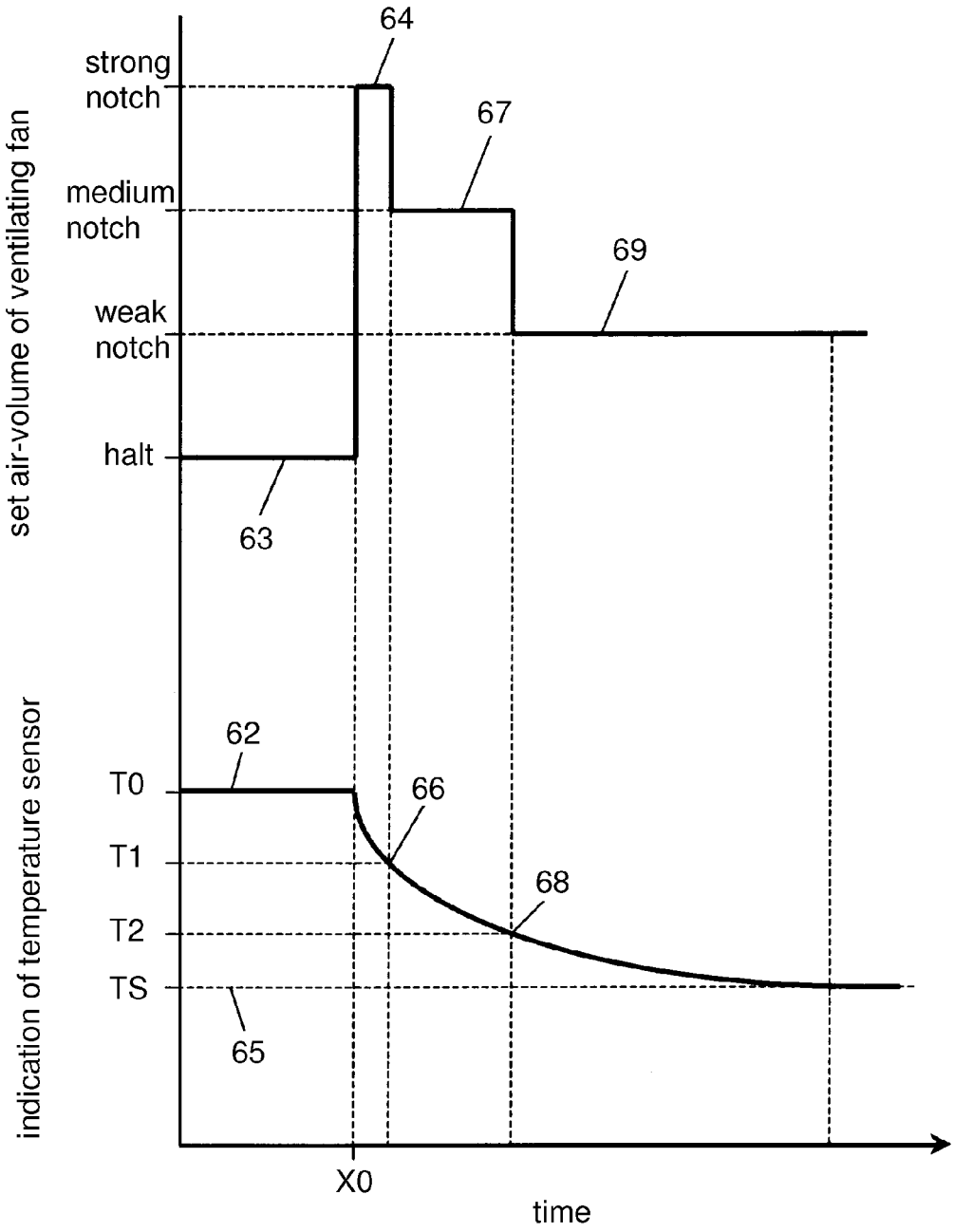
FIG. 8 shows timing charts illustrating relations between an indication of a temperature sensor and an air volume of a ventilating fan of the ventilating and air-conditioning apparatus during a cool operation of the ventilating and air-conditioning apparatus.

FIG. 8 shows timing charts illustrating relations between an indication of temperature sensor 58 and an air volume of ventilating fan 12 during the "cool" operation. The horizontal axis represents the time and the vertical axis represents an indication (sensed value) 60 of temperature sensor 58 and also set air-volume 61 of ventilating fan 12.

Temperature sensor 58 is placed around sucking port 17 of main unit 6. During the "cool" operation circulating fan 21 and ventilating fan 12 suck the air from bathroom 3 through sucking port 17, so that temperature sensor 58 senses the air in bathroom 3 and outputs indication 60.

In the timing chart shown in FIG. 8, the "cool" operation starts at time "X0" marked on the horizontal axis. A user sets a temperature to his or her taste, and pushes a start button for starting the "cool" operation. Indication 60 indicating the temperature in bathroom 3 starts lowering gradually from the initial value T0, e.g. 35° C., marked on scale 62 of the vertical axis. Ventilating fan 12 is halted before the "cool" operation starts. Air volume 61 of fan 12 is set correspondingly to the halt state indicated by scale 63. When the "cool" operation starts, controller 59 issues a command to fan 12, which then works at the strong notch indicated on scale 64 of the vertical axis.

Assume that a target temperature of the "cool" operation is set at temperature TS, e.g. 20° C., marked on scale 65 of the vertical axis. Temperature TS is greatly lower than the initial temperature T0 in bathroom 3, and the temperature in bathroom 3 lowers gradually following the continuous "cool" operation, so that the difference between set-temperature TS and the temperature in bathroom 3 becomes smaller step by step. The cooling load of bathroom 3 thus decreases step by step.

When indication 60 of temperature sensor 58 reaches first given temperature T1, e.g. 30° C., indicated on scale 66, controller 59 changes air-volume 61 from the present strong notch to a medium notch marked on scale 67 lower than the strong notch. This change prompts ventilating fan 12 to reduce the air volume, so that an amount of the air to be evacuated through exhausting ducts 9 and 11 to the outdoors decreases, which entails a decrease in an amount of fresh air to be taken into air-supply port 13. The air-conditioning load of living room 2 applied to air-conditioner 14 thus lowers and air-conditioner 14 can reduce its air-conditioning energy. As a result, the loss in air-conditioning energy of entire living space 1 can be reduced.

The "cool" operation goes on working, and when indication 60 of temperature sensor 58 reaches second given value T2, e.g. 25° C., indicated on scale 68, controller 59 changes set air-volume 61 from the medium notch to a weak notch marked on scale 69 lower than the medium notch. This weak notch indicates the same air volume as that produced during the "around-the-clock ventilation" operation, so that a ventilation amount necessary for living space 1 is taken in, while energy of cooled air is collected from the conditioned air evacuated through exhausting ducts 9 and 11. As a result, the "cool" operation achieves an extremely high level of energy saving.

As discussed above, during the "cool" operation, when the temperature in bathroom 3 lowers to a temperature lower than the second given temperature, ventilating fan 12 is controlled such that its set air volume decreases step by step. To be more specific, an amount of exhausted air, i.e. the heat source, is controlled in response to the cooling load of bathroom 3. The cooling environment in bathroom 3 can be maintained while an amount of fresh air flowing into living room 2 through air-supplying port 13 is reduced for lowering the loss in air-conditioning energy used for living room 2. As a result, entire living space 1 can be efficiently ventilated and air-conditioned.

Figure 9:
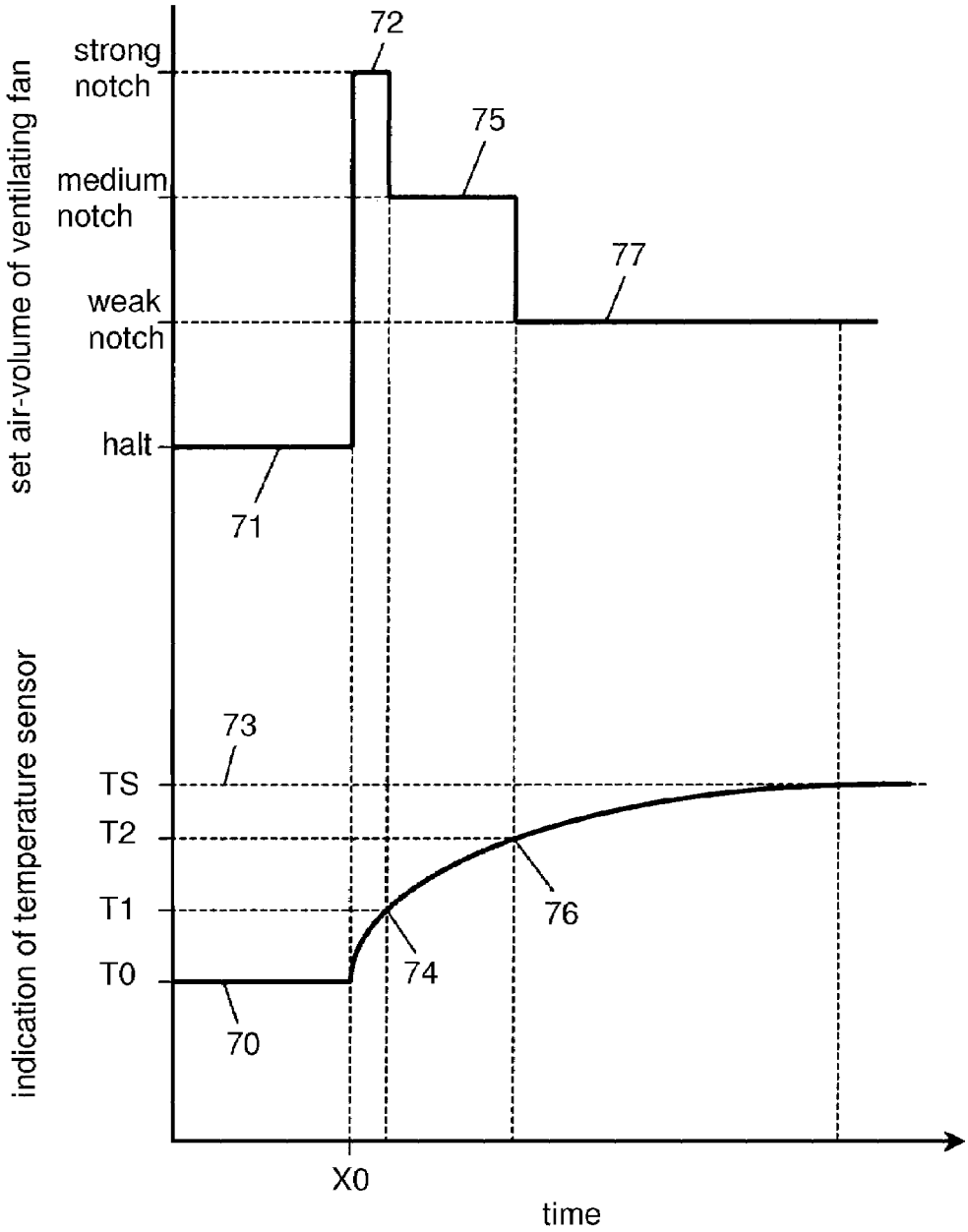
FIG. 9 shows timing charts illustrating relations between an indication of a temperature sensor and an air volume of the ventilating fan of the ventilating and air-conditioning apparatus during a heat operation of the ventilating and air-conditioning apparatus.

FIG. 9 shows timing charts illustrating relations between an indication of temperature sensor 58 and an air volume of ventilating fan 12 during the "heat" operation. The horizontal axis of the timing chart in FIG. 9 represents the time, and the vertical axis represents indication 60 of temperature sensor 58 and set air-volume 61 of ventilating fan 12.

Temperature sensor 58 is placed around sucking port 17 of main unit 6. During the "heat" operation, circulating fan 21 and ventilating fan 12 suck the air from bathroom 3 through sucking port 17, so that temperature sensor 58 senses the temperature of the air in bathroom 3 and outputs indication 60.

In the timing chart shown in FIG. 9, the "heat" operation starts at time "X0" marked on the horizontal axis. A user sets a temperature to his or her taste, and pushes a start button for starting the "heat" operation. Indication 60 indicating the temperature in bathroom 3 starts rising gradually from the initial value T0, e.g. 15° C., marked on scale 70 of the vertical axis. Ventilating fan 12 is halted before the "heat" operation starts. Air volume 61 of fan 12 is set correspondingly to the halt state indicated at scale 72. When the "heat" operation starts, controller 59 issues a command to fan 12, which then works at the strong notch indicated on scale 72 of the vertical axis.

Assume that a target temperature of the "heat" operation is temperature TS, e.g. 40° C., marked on scale 73 of the vertical axis. Temperature TS is greatly higher than the initial temperature T0 in bathroom 3, and the temperature in bathroom 3 rises gradually following the continuous "heat" operation, so that the difference between set-temperature TS and the temperature in bathroom 3 becomes smaller gradually. The heating load of bathroom 3 thus gradually decreases.

When indication 60 of temperature sensor 58 reaches second given temperature T2, e.g. 25° C., indicated on scale 74, controller 59 changes air-volume 61 from the present strong notch the medium notch marked on scale 75 lower than the strong notch. This change prompts ventilating fan 12 to reduce its air volume, so that an amount of the air to be evacuated through exhausting ducts 9 and 11 to the outdoors decreases, which entails a decrease in an amount of fresh air to be taken into air-supply port 13. The air-conditioning load of living room 2 thus lowers and air-conditioner 14 reduces its air-conditioning energy. As a result, the loss in the air-conditioning energy for entire living space 1 can be reduced.

The "heat" operation goes on working, and when indication 60 of temperature sensor 58 reaches first given value T2, e.g. 35° C. indicated on scale 76, controller 59 changes set air-volume 61 from the medium notch to a weak notch marked on scale 77 lower than the medium notch. This weak notch indicates the same air volume as that produced during the "around-the-clock ventilation" operation, so that a ventilation amount necessary for living space 1 is taken in, while the heat is collected from the conditioned air evacuated through exhausting ducts 9 and 11. As a result, the "heat" operation achieves an extremely high level of energy saving.

As discussed above, during the "heat" operation, when the temperature in bathroom 3 rises to a temperature higher than the first given temperature, ventilating fan 12 is controlled such that its set air volume decreases step by step. To be more specific, an amount of exhausted air, i.e. the heat source, is controlled in response to a heating load of bathroom 3. The heating environment in bathroom 3 can be maintained while an amount of fresh air flowing into living room 2 through air-supplying port 13 is reduced for lowering the loss in air-conditioning energy used for living room 2. As a result, entire living space 1 can be efficiently ventilated and air-conditioned.

The structure and working discussed above prove that the air-conditioning apparatus of a bathroom in accordance with the second embodiment of the present invention produces the following advantages.

In second heat exchanger 29, the refrigerant absorbs heat from the air which is sucked from dressing room 4 and toilet room 5 and is to be evacuated to the outdoors by ventilating fan 12. In first heat exchanger 27, the refrigerant radiates heat to the air circulated in bathroom 3 by circulating fan 21. A heat pump starts working with a heat source using the air sucked from dressing room 4 and toilet room 5 and to be evacuated to the outdoors, so that bathroom 3 is heated. The air heated by first heat exchanger 27 thus does not leak outside bathroom 3, which can be thus efficiently heated, and the thermal efficiency can be improved.

On top of that, the structural elements of refrigerant circuit 25, i.e. compressor 26, first heat exchanger 27, expanding mechanism 28, and second heat exchanger 29, can be accommodated in ventilating and air-conditioning apparatus 110 installed under the roof of bathroom 3. This structure allows achieving space-saving and improving the installing work of air-conditioning apparatus 110.

In second heat exchanger 29, the refrigerant radiates heat to the air sucked from dressing room 4 and toilet room 5 and to be evacuated to the outdoors by ventilating fan 12. In first heat exchanger 27, the refrigerant absorbs heat from the air circulated in bathroom 3 by circulating fan 21. This circulating air works as heat source of the heat pump, which then cools bathroom 3. The air cooled by first heat exchanger 27 will not leak outside bathroom 3, which can be thus cooled efficiently. The thermal efficiency can be thus improved.

When bathroom 3 is air-conditioned, a greater wind volume can be used than a wind volume used in ventilating the dressing room 4 and toilet room 5. This increment in the wind volume allows second heat exchanger 29 to absorb or radiate a greater amount of heat, so that sufficient air-conditioning power can be obtained.

The air conditioned by air-conditioner 14 installed outside bathroom 3 is sucked from evacuating ports 8 and 10 and supplied to second heat exchanger 29, so that the thermal energy produced outside bathroom 3 by air-conditioner 14 can be collected. Further improvement in the thermal efficiency thus can be expected.

The presence of ventilation path 23, which connects bathroom 3 to the suction side of ventilating fan 12, and shutter 24, which opens or closes shutter 24, allows achieving an efficient air-conditioning of bathroom 3 by setting shutter 24 to the closed state for preventing the conditioned air from being exhausted. Setting shutter 24 to the open state allows quick evacuation of the air from bathroom 3, so that bathroom 3 can be ventilated and dried.

In the case of drying bathroom 3, the refrigerant absorbs heat from the air which flows through ventilation path 23 in second heat exchanger 29 and is to be evacuated to the outdoors, so that the heat radiated to the air of bathroom 3 in first heat exchanger 27 can be collected. As a result, drying efficiency can be improved.

During the "heat" operation, when the temperature in bathroom 3 rises to a temperature higher than the first given temperature, ventilating fan 12 reduces its blowing air-volume so that the loss in air-conditioning energy can decrease.

During the "heat" operation, ventilating fan 12 is controlled such that its blowing air-volume decreases step by step, whereby an air-volume (heat source) to be evacuated can be controlled in response to the heating load of bathroom 3. The loss in air-conditioning energy produced by ventilation can be reduced.

During the "heat" operation, when the temperature in bathroom 3 rises to a temperature higher than the first given temperature, ventilating fan 12 is controlled to work solely so that a blowing air-volume of ventilating fan 12 can decrease to a similar volume to the air-volume necessary for ventilating the indoor spaces to which exhausting ports 8 and 10 are open. This control allows collecting heat from the air evacuated from exhausting ports 8 and 10, and also allows heating bathroom 3 while an air-volume necessary for ventilating living space 1 is taken in. The heat operation thus can achieve an extremely high level of energy saving.

During the "cool" operation, when the temperature in bathroom 3 lowers to a temperature lower than the second given temperature, ventilating fan 12 is controlled such that its blowing air-volume decreases. This control allows reducing the loss in air-conditioning energy produced by ventilation.

During the "cool" operation, ventilating fan 12 is controlled such that its blowing air-volume decreases step by step, whereby an air-volume (heat source) to be exhausted can be controlled in response to the cooling load of bathroom 3. This control allows reducing the loss in air-conditioning energy produced by ventilation.

During the "cool" operation, when the temperature in bathroom 3 lowers to a temperature lower than the second given temperature, ventilating fan 12 is controlled to work solely so that the air-volume can decrease to a similar volume to the air-volume necessary for ventilating the indoor spaces, to which exhausting ports 8 and 10 are open. This control allows collecting the energy of cooled air from the air evacuated from exhausting ports 8 and 10, and also allows cooling bathroom 3 while air-volume necessary for ventilating living space 1 is taken in. The "cool" operation thus can achieve an extremely high level of energy saving.

The descriptions discussed previously are only the embodiments, and the present invention is not limited to those embodiments. For instance, in embodiments 1 and 2, the first living space to be air-conditioned is bathroom 3, and the indoor spaces to which exhausting ports are open are dressing room 4 and toilet room 5. However, the space to be air-conditioned and the space to which the exhausting ports are open are not necessarily limited to the foregoing rooms, but they can be any spaces partitioned in the living space. In other words, the space to be air-conditioned can be a living room, and the space to which the exhausting port is open can be a bathroom.

In embodiments 1 and 2, the exhausting ports are open to dressing room 4 and toilet room 5; however, the number and location of the ports are not necessarily limited to this structure. For instance, a single exhausting port can be placed only in a toilet.

In embodiments 1 and 2, expanding mechanism 28 employs the capillary tube; however, mechanism 28 can be an electronic expanding valve, or it can be any type as far as it can decompress and expand the refrigerant.

In embodiment 1, refrigerant circuit 25 is provided with dual bypass circuits, namely, bypass circuits 31 and 32; however, refrigerant circuit 25 can also work with a single bypass circuit.

In embodiment 1, refrigerant heating device 35 is placed in parallel with second heat exchanger 29; however, device 35 can be placed in refrigerant circuit 25 and in series with second heat exchanger 29.

In embodiment 1, first on-off valve 33 and second on-off valve 34 are switched between the open state and the closed state; however, the on-off valve can be, e.g. an electronic expanding valve, and the on-off valve can be any type as far as it can open or close the bypass circuit.

In embodiment 1, refrigerant heating device 35 employs one of two device, namely, refrigerant heater 40 or refrigerant-hydrothermal exchanger 47; however device 35 is not necessarily limited to one of these two types, but device 35 can be any type as far as it can heat the refrigerant.

In first embodiment 1, refrigerant-hydrothermal exchanger 47 receives hot water from heat-pump type water heater 48 at its water side pipe; however, the water heater is not limited to the heat-pump type, but it can be any type as far as it can supply hot water at a high temperature (e.g. 40-90° C.) or water at an ordinary temperature (e.g. 1-40° C.) to the water side pipe of exchanger 47. For instance, the water heater can be a gas water heater, electric water heater, oil-burning water heater, or it can employ a structure which circulates water or another structure which supplies tap water, or a structure which circulates the water of a bathtub.

In embodiment 2, controller 59 controls ventilating fan 12 such that set air-volume 61 of fan 12 can be changed into three levels based on indication 60 of temperature sensor 58; however, the method of controlling the air-volume of ventilating fan 12 is not limited to the foregoing one. For instance, the air volume can be changed into two levels, or into four levels or more than four levels. Fan 12 can be driven by a DC motor, so that the air volume can be changed linearly.

INDUSTRIAL APPLICABILITY

A ventilating and air-conditioning apparatus of the present invention improves space-saving characteristics and installation work, and reduces the leakage of conditioned air to the outdoors for increasing the thermal efficiency. This ventilating and air conditioning apparatus can be used for ventilating and air-conditioning not only a bathroom but also a living room, bedroom, kitchen, and washroom.

The invention claimed is:

1. A ventilating and air conditioning apparatus comprising:

a circulating fan for sucking air through a sucking port open to a first indoor space and blowing air through a blowout port open to the first indoor space;

a ventilating fan configured to suck air through an exhausting port open to a second indoor space and the sucking port open to the first indoor space and evacuate the air to outdoors for carrying out ventilation;

a refrigerant circuit including:

a compressor for compressing a refrigerant;

a first heat exchanger for exchanging heat of the air blown into the first indoor space by the circulation fan with the refrigerant;

an expanding mechanism for expanding the refrigerant; and a second heat exchanger for exchanging heat of air sucked from the second indoor space by the ventilating fan with the refrigerant, wherein the compressor, the first heat exchanger, the expanding mechanism, and the second heat exchanger are coupled to each other with pipes for the refrigerant to circulate therethrough in this order, the ventilating and air conditioning apparatus further comprising a flow-path switching valve for switching a circulating direction of the refrigerant firstly to the compressor, secondly to the second heat exchanger, then to the expanding mechanism, and then to the first heat exchanger in this order, wherein the refrigerant in the second heat exchanger radiates heat to air to be evacuated to the outdoors by the ventilating fan, and the refrigerant in the first heat exchanger absorbs heat from air to be circulated in the first indoor space by the circulating fan for cooling the first indoor space.

2. The ventilating and air conditioning apparatus of claim 1, wherein the refrigerant in the second heat exchanger absorbs heat from air to be evacuated to the outdoors, and the refrigerant in the first heat exchanger radiates heat to air to be circulated in the first indoor space for heating the first indoor space.

3. The ventilating and air conditioning apparatus of claim 1 further comprising:

a decompressing device in a pipe of the first heat exchanger for decompressing the refrigerant flowing in the pipe, wherein the refrigerant on a downstream side of the decompressing device absorbs heat from air blown by the circulating fan, and then the refrigerant on an upstream side of the decompressing device radiates heat for dehumidifying the first indoor space.

4. The ventilating and air conditioning apparatus of claim 1, wherein the ventilating fan is operated for heating, cooling, or dehumidifying the first indoor space with a greater air volume of the ventilating fan than an air volume to be produced by only the ventilating fan for ventilating the second indoor space.

5. The ventilating and air conditioning apparatus of claim 1, wherein the exhausting port sucks air that has been conditioned by an air-conditioner disposed outside the first indoor space.

6. The ventilating and air conditioning apparatus of claim 1 further comprising:

a ventilation path connecting the first indoor space to a sucking side of the ventilating fan; and a shutter for opening and closing the ventilation path, wherein the shutter is set to a closed state for air-conditioning the first indoor space, and the shutter is set to an open state for ventilating or drying the first indoor space.

7. The ventilating and air conditioning apparatus of claim 6, wherein the refrigerant in the second heat exchanger absorbs heat from air sucked from the first indoor space and to be evacuated to the outdoors through the ventilation path for drying the first indoor space.

8. The ventilating and air conditioning apparatus of claim 6, wherein the ventilation path communicates with the first indoor space via the sucking port.

9. The ventilating and air-conditioning apparatus of claim 1 further comprising:

an auxiliary heater for heating at least a part of air blown by the circulating fan.

10. The ventilating and air conditioning apparatus of claim 9, wherein the auxiliary heater is a radiation type heater for dispersing radiant heat in the first indoor space.

11. The ventilating and air conditioning apparatus of claim 1 further comprising:

a pre-heater for pre-heating air before the air is supplied to the second heat exchanger by the ventilating fan.

12. The ventilating and air conditioning apparatus of claim 1, wherein the flow-path switching valve is switched based on a temperature of the refrigerant in the first heat exchanger or the second heat exchanger.

13. The ventilating and air conditioning apparatus of claim 1 further comprising:

a bypass circuit which branches off from the refrigerant circuit running from a discharging side of the compressor to the expanding mechanism, and merges into the refrigerant circuit running from the expanding mechanism to a sucking side of the compressor; and an on-off valve for opening and closing the bypass circuit.

14. The ventilating and air conditioning apparatus of claim 1 further comprising:

a refrigerant heating device disposed in parallel with or in series with the second heat exchanger in the refrigerant circuit for heating the refrigerant.

15. The ventilating and air conditioning apparatus of claim 14, wherein the refrigerant heating device is a refrigerant heater which heats the refrigerant with electric heat.

16. The ventilating and air conditioning apparatus of claim 14, wherein the refrigerant heating device is a refrigerant-hydrothermal exchanger which heats the refrigerant by exchanging heat between the refrigerant and hot water supplied from a water heater.

17. The ventilating and air conditioning apparatus of claim 16, wherein the hot water to be supplied to the refrigerant-hydrothermal exchanger is heated by a heat-pump type water heater.

18. The ventilating and air conditioning apparatus of claim 16, wherein the hot water having undergone a heat-exchange with the refrigerant in the refrigerant-hydrothermal exchanger is evacuated through a drain pipe which evacuates dew water occurred in the first heat exchanger or the second heat exchanger.

19. The ventilating and air conditioning apparatus of claim 16, wherein water at an ordinary temperature is supplied to the refrigerant-hydrothermal exchanger so that the refrigerant can radiate heat in the refrigerant-hydrothermal exchanger.

20. The ventilating and air conditioning apparatus of claim 1 further comprising:

a controller for controlling the ventilating fan to decrease an air volume when a temperature in the first indoor space is higher than a first given temperature or lower than a second given temperature which is lower than the first given temperature.

21. The ventilating and air conditioning apparatus of claim 20, wherein the controller controls the ventilating fan to decrease an air volume step by step.

22. The ventilating and air conditioning apparatus of claim 20, wherein the controller controls the ventilating fan to decrease an air volume to an equal level to an air volume produced by operating only the ventilating fan for ventilating the second indoor space.

23. A ventilating and air conditioning apparatus comprising a main unit configured to be installed in a ceiling portion of a first indoor space, the main unit configured to be connected with an outdoor exhausting duct for coupling the main unit to outdoors and a second exhausting duct for coupling the main unit to a second indoor space, the main unit comprising:

a circulating fan disposed in a circulation path for sucking air through a portion of a sucking port open to the first indoor space and blowing air through a blowout port open to the first indoor space;

a ventilating fan disposed in a ventilation path for sucking air through an exhausting port coupled to the second exhausting duct and through another portion of the sucking port and evacuating the air to outdoors for carrying out ventilation; and a refrigerant circuit including:

a compressor for compressing a refrigerant;

a first heat exchanger disposed in the circulation path for exchanging heat of the air blown into the first indoor space by the circulation fan with the refrigerant;

an expanding mechanism for expanding the refrigerant; and a second heat exchanger disposed in the ventilation path for exchanging heat of air from the second indoor space with the refrigerant, wherein the refrigerant circuit further includes a flow path switching valve for controlling the refrigerant flow so that the refrigerant flows, during a heating cycle, from the compressor to the first heat exchanger, to the expanding mechanism, to the second heat exchanger, and back to the compressor, and, during a cooling cycle, from the compressor to the second heat exchanger, to the expanding mechanism, to the first heat exchanger and back to the compressor.

24. The ventilating and air conditioning apparatus of claim 23, further comprising a shutter disposed in the ventilation path in vicinity of the another portion of the sucking port for opening and closing the ventilation path, the shutter operatively opened so that the ventilating fan can suck air through the another portion of the sucking port and evacuate the air outdoors through the outdoor exhausting duct.

25. The ventilating and air conditioning apparatus of claim 23, wherein the refrigerant circuit further comprises:

a first bypass circuit connecting an output of the flow path switching valve to the second heat exchanger, the first bypass circuit including a first on-off valve for opening and closing the first bypass circuit; and a second bypass circuit connecting an output of the first heat exchanger to the flow path switching valve, the second bypass circuit including a second on-off valve for opening and closing the second bypass circuit and a refrigerant heating device.

26. The ventilating and air conditioning apparatus of claim 25, wherein the main unit is operative during a dehumidify operation to:

close the shutter and the first on-off valve;

open the second on-off valve; and control the flow path switching valve so that the refrigerant flows from the compressor to the first heat exchanger and back to the compressor.

27. The ventilating and air conditioning apparatus of claim 25, wherein the main unit is operative during a frost removal operation to:

close the shutter, the first on-off valve, and the second on-off valve;

halt the circulating fan and the ventilating fan; and control the flow path switching valve so that the refrigerant flows from the compressor to the second heat exchanger to melt frost attached to the second exchanger, to the expanding mechanism, to the first heat exchanger and back to the compressor.

28. The ventilating and air conditioning apparatus of claim 25, wherein the main unit is operative during a frost removal and heating operation to:

open the first on-off valve and the second on-off valve; and control the flow path switching valve so that refrigerant flows from the compressor and a first portion of the refrigerant branches to the first heat exchanger and a second portion of the refrigerant branches to the first bypass circuit, the first portion of the refrigerant branched to the first heat exchanger to radiate heat to the air circulated by the circulating fan and then flowing to the second bypass circuit to be heated by the refrigerant heating device, the second portion of the refrigerant flowing to the second heat exchanger to melt frost attached to the second exchanger and returning to the compressor.

29. The ventilating and air conditioning apparatus of claim 23, further comprising a wall portion disposed within the main unit for forming the circulation path and the ventilation path, the circulation path connecting the portion of a sucking port to the blowout port open to the first indoor space, the ventilation path connecting another portion of the sucking port open to the first indoor space to a sucking side of ventilating fan.

* * * * *